US005687624A

United States Patent [19]

Tsuge et al.

[11] Patent Number: 5,687,624

[45] Date of Patent: Nov. 18, 1997

[54] CONTINUOUS SCREW DRIVING TOOL

[75] Inventors: Kazunori Tsuge; Masahiko Inai, both of Anjo, Japan

[73] Assignee: Makita Corporation, Aichi-ken, Japan

[21] Appl. No.: 604,035

[22] Filed: Feb. 20, 1996

[30] Foreign Application Priority Data

Feb. 20, 1995 [JP] Japan ..... 7-030788

[51] Int. Cl.[6] ..... B25B 23/06

[52] U.S. Cl. ..... 81/434; 81/57.37; 227/120

[58] Field of Search ..... 81/57.37, 434; 227/120

[56] References Cited

FOREIGN PATENT DOCUMENTS

| | | |
|---|---|---|
| 7 521373 | 7/1975 | Germany . |
| 2 641828 | 3/1978 | Germany . |
| 3 347323 | 3/1978 | Germany . |
| 4208715 | 9/1992 | Germany . |
| 4 315403 | 11/1994 | Germany . |
| 4 119925 | 2/1995 | Germany . |
| 5-337837 | 12/1993 | Japan . |

*Primary Examiner*—James G. Smith

*Attorney, Agent, or Firm*—Dennison, Meserole, Pollack & Scheiner

[57] ABSTRACT

A continuous screw driving tool includes a body having a rotatably spindle for mounting a driver bit thereon. A feeder box having a screw feeding device for feeding a screw carrying belt is movable relative to a case which is fixed to the body. A stopper base is adapted to be mounted on the feeder box for abutment on a work into which a screw is to be driven. A first and second stopper mechanisms are provided for limiting a first stroke of the stopper base in a direction to extend outwardly from the case and a second stroke end of the stopper base in the opposite direction, respectively. The second stopper mechanism includes a first stopper member on the side of the body and a second stopper member on the side of the stopper base for abutment on the first stopper member. The second stopper member is movable with the stopper base as the stopper base is moved toward the second stroke end. The feeder box is adapted to selectively mount any one of plural kinds of the stopper bases each suited for a group of screws having different lengths. A stroke changing mechanism is provided for changing the position of the second stroke end in accordance with the change of the stopper base.

6 Claims, 13 Drawing Sheets

CONTINUOUS SCREW DRIVING TOOL

BACKGROUND OF THE INVENTION

1. Field of the Invention

The present invention relates to a continuous screw driving tool for continuously driving screws carried by a screw carrying belt.

2. Description of the Prior Art

The assignee of the present invention has proposed various improvements in a continuous screw driving tool for providing an excellent operability. For example, Japanese Laid-Open Patent Application No. 5-337837 in the name of the same assignee as the present invention discloses a continuous screw driving tool in which a stopper mechanism having an upper stopper and a lower stopper is provided for limiting an upper stroke end of a stopper base. The upper stopper is mounted on a case which is fixed to a body of the tool. The lower stopper is formed on the stopper base. The stopper base is adapted for abutment on a work and can be mounted on a feeder box having a screw feeding device at different heights according to the length of the screws to be driven, so that the distance between the upper stopper and the lower stopper can be varied. This enables the tool to have a simple construction and to operate for automatically changing the distance of upper stroke movement of the stopper base in accordance with change in the length of the screws to be driven.

However, this conventional continuous screw driving tool involves a problem in that the tool cannot cope with a broader range of screw length. Thus, in order to cope with screws having a greater length, the stopper base must be positioned at lower position relative to the feeder box, so that the lower stopper is positioned at a lower position to provide greater distance of upper stroke movement. Therefore, the feeder box and the case of the tool must have a greater length, while the length of the feeder box and the case is limited due to the constructive reason. Therefore, the range of length of screws adapted to the conventional tool is normally limited between 25 mm to 40 mm, and the conventional tool cannot cope with screws having a greater length such as 51 mm and 57 mm.

SUMMARY OF THE INVENTION

It is, accordingly, an object of the present invention to provide a continuous screw driving tool which can cope with a greater range of screw length while a feeder box as well as a case of the tool does not have a greater length.

It is another object of the present invention to provide a continuous screw driving tool which is excellent in operability.

According to the present invention, there is provided a continuous screw driving tool comprising:

a body having a spindle rotatably driven by a drive device and adapted for mounting a driver bit thereon;

a case mounted on the body and having a longitudinal axis parallel to a longitudinal axis of the spindle;

a feeder box movable relative to the case in the axial direction of the case;

a stopper base adapted to be mounted on the feeder box for abutment on a work into which a screw is to be driven;

a first stopper mechanism for limiting a first stroke end of the stopper base in a direction to extend outwardly from the case;

a second stopper mechanism for limiting a second stroke end of the stopper base on the side opposite to the first stroke end;

a biasing member for normally biasing the stopper base in a direction toward the first stopper end;

a screw feeding device operable to feed screws carried on a screw carrying belt to a position confronting the driver bit one after another when the stopper base is moved from the first stroke end toward the second stroke end against the biasing force of the biasing member;

the second stopper mechanism including a first stopper member on the side of the body and a second stopper member on the side of the stopper base for abutment on the first stopper member, the second stopper member being movable with the stopper base as the stopper base is moved toward the second stroke end;

the feeder box being adapted to selectively mount any one of plural kinds of the stopper bases each suited for a group of screws having different lengths; and a stroke changing mechanism provided for changing the position of the second stroke end in accordance with the change of the stopper base.

With this construction, the operator selects the stopper base suited for a desired screw length and fixes the stopper base on the feeder box at suitable position, while he operates the stroke changing mechanism to change the position of the second stroke end suitable to the selected stopper base.

Thus, with the present invention, the tool can cope with a broader range of screw length, so that the availability of the tool can be improved.

The invention will become more fully apparent from the claims and the description as it proceeds in connection with the drawings.

DETAILED DESCRIPTION OF THE PREFERRED EMBODIMENTS

A first embodiment of the present invention will now be described with reference to FIGS. 1 to 10(A) and 10(B).

Figure 1:
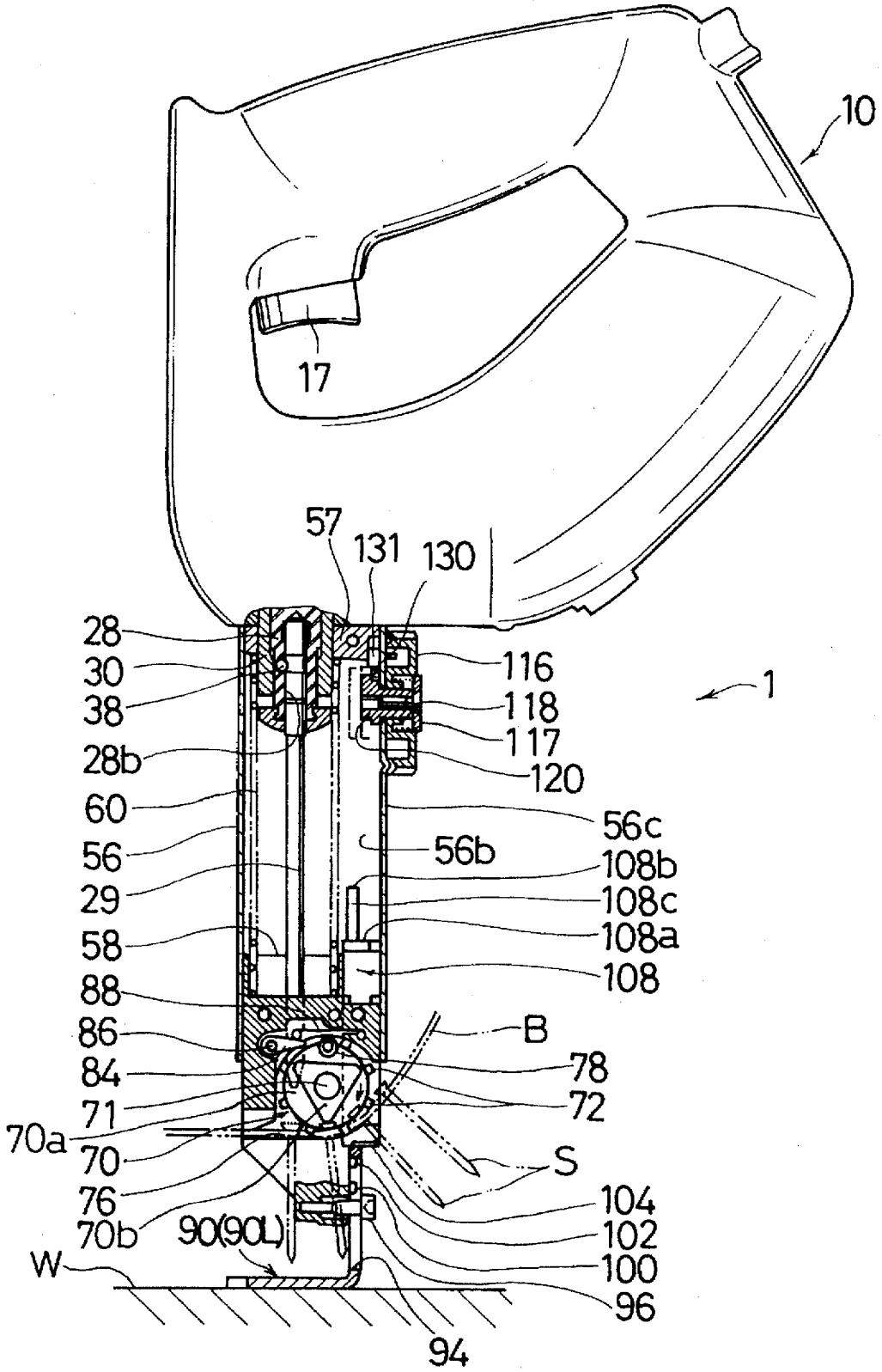
FIG. 1 is a view, with a part broken away, of a continuous screw driving tool according to a first embodiment of the present invention.

Referring to FIG. 1, there is shown a continuous screw driving tool having a body 10 which has a substantially D-shaped configuration. Although not shown in the drawings, a drive motor, a reduction gear mechanism and a clutch mechanism, etc. are disposed within the body 10. The motor is started by pulling a trigger switch 17, and the rotation of the motor is transmitted to a spindle 28 through the reduction gear mechanism and the clutch mechanism.

Figure 2:
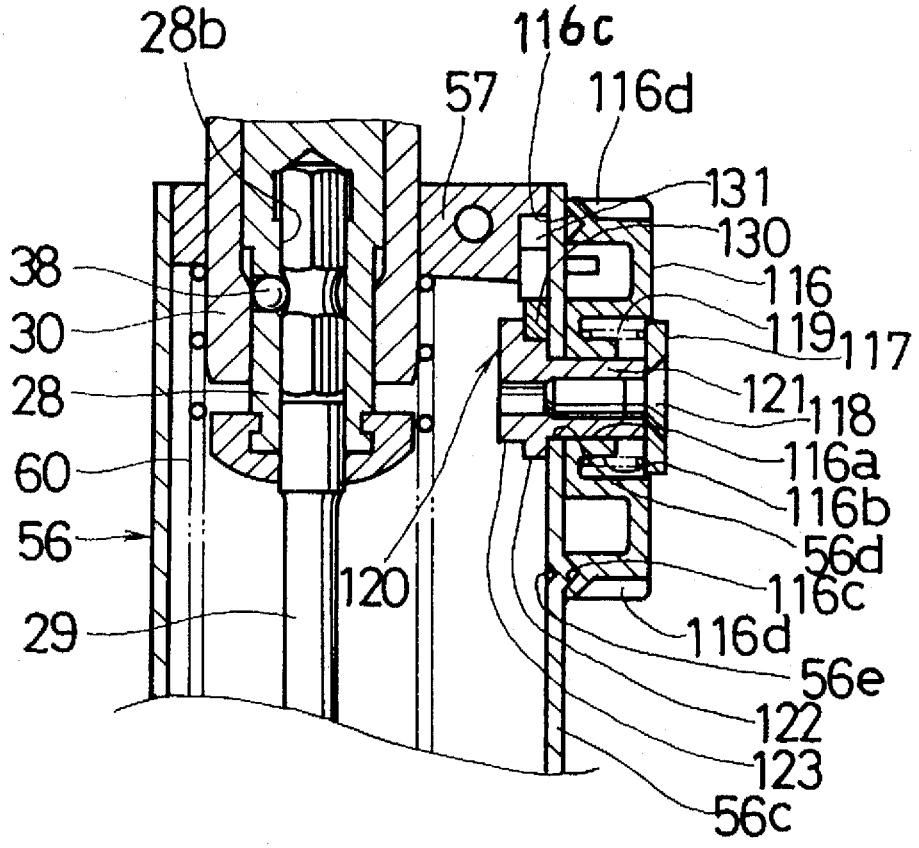
FIG. 2 is an enlarged vertical sectional view of a stroke switching mechanism shown in FIG. 1.

The spindle 28 is rotatably supported by a cylindrical bearing 30 mounted on the lower portion of the body 10 and extends downwardly from the body 10. The spindle 28 is movable in an axial direction relative to the bearing 30 within a predetermined range. As shown in FIG. 2, a mounting hole **28*b* is formed in the lower end of the spindle 28 for receiving a driver bit 29. A steel ball 38 is disposed to partly enter the mounting hole 28*b* for preventing the driver bit 29 from removal from the mounting hole 28*b*. A hollow case 56 having a rectangular configuration in section is mounted on the lower portion of the body 10 and extends downwardly therefrom. The case 56 has a longitudinal axis extending in parallel to the axis of the spindle 28, and the spindle 28 extends downwardly into the upper portion of the case 56. A fork-like member 57 is mounted within an upper portion of the case 56 which fixedly clamps the bearing 30, so that the case 56 is fixed to the lower portion of the body 10**.

Figure 3:
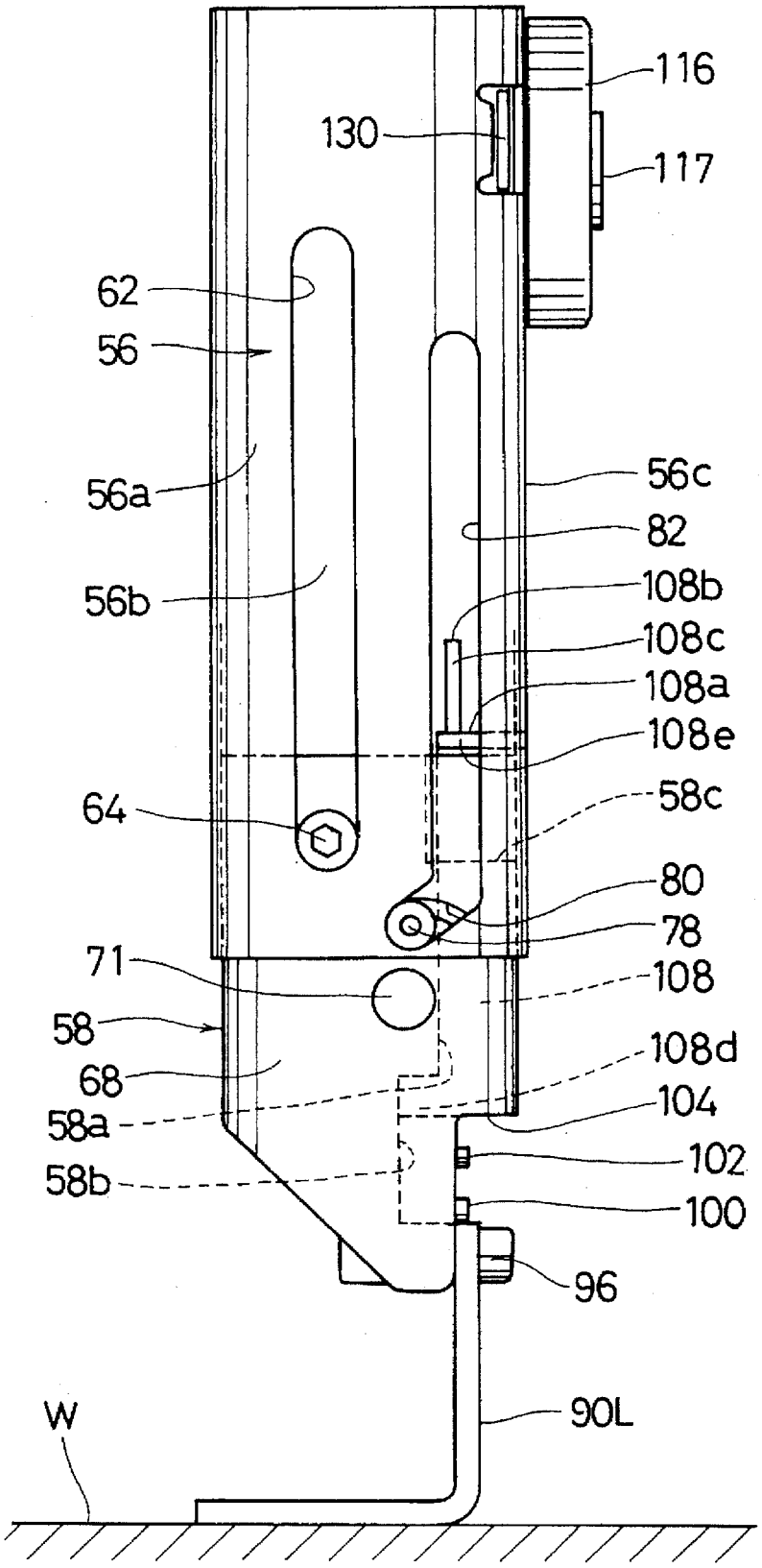
FIG. 3 is a left side view of the essential parts of the tool shown in FIG. 1.

A feeder box 58 is vertically movably fitted within the case 56 and is normally biased downwardly by means of a compression coil spring 60. As shown in FIG. 3, the case 56 has a left side plate **56*a* including a vertically elongated slot 62 formed therein. A bolt 64 is screwed into a corresponding side plate of the feeder box 58 facing to the case 56. The bolt 64 has a head projecting into the elongated slot 62, so that the stroke of vertical movement of the feeder box 58 is limited within the length of the elongated slot 62. Since the feeder box 58 is normally biased in the downward direction by the compression spring 60, the feeder box 58 is normally held in its lower stroke end where the head of the bolt 64 is abuts on the case 56 at the lowermost end of the elongated slot 62 as shown in FIG. 3. Thus, the bolt 64 and the slot 62 constitute a vertical guide mechanism of the feeder box 58, and such a guide mechanism is also provided between a right side plate 56*b* opposite to the left side plate 56*a* and a corresponding side plate of the feeder box 58**.

Figure 4:
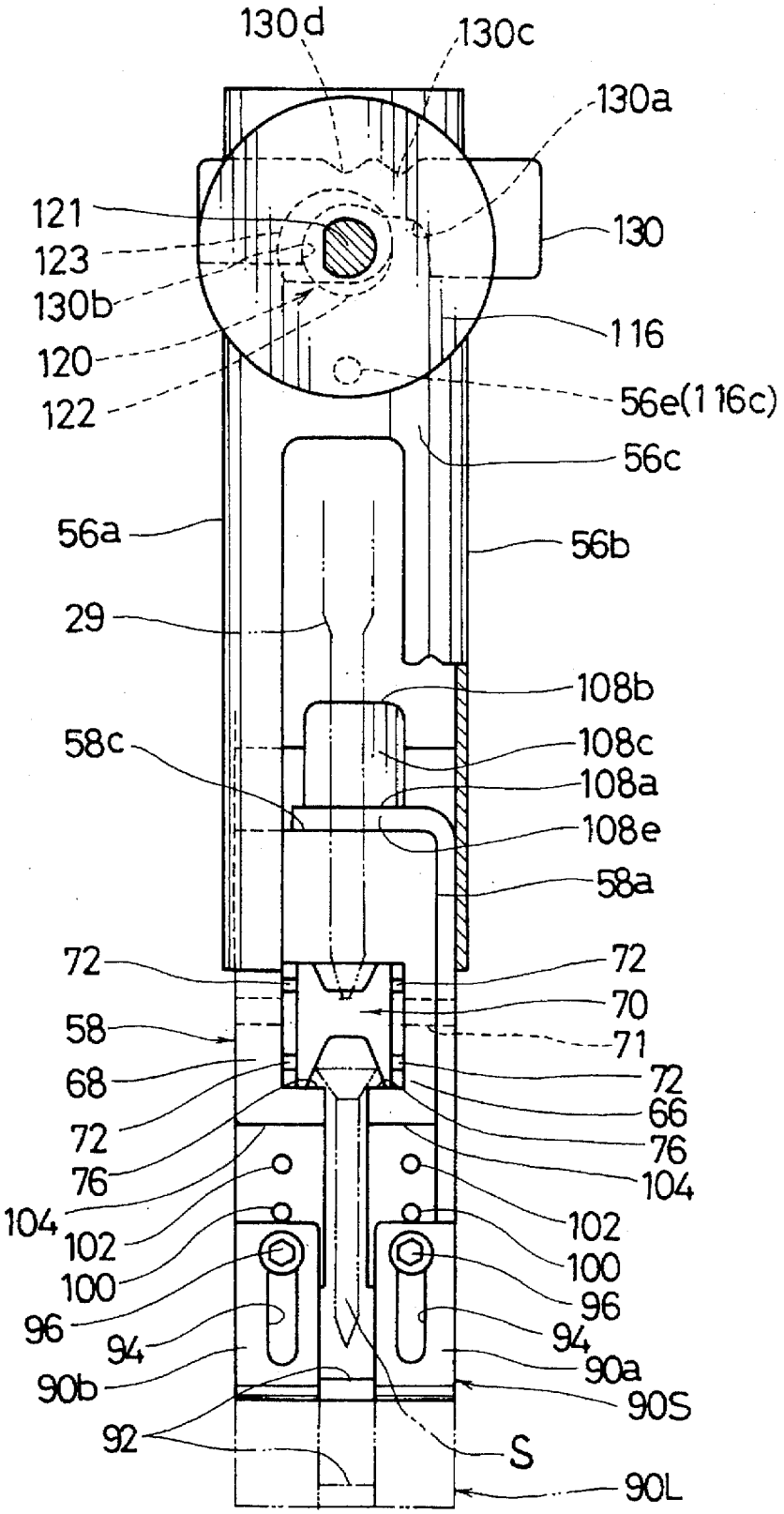
FIG. 4 is a rear view of FIG. 3.

A screw feeder is mounted on the feeder box 58 for feeding screws S carried on a screw carrying belt B one after another to a position vertically confronting the driver bit 29 as the feeder box 58 is vertically reciprocally moved. The screw feeder itself is well known, and the construction of the screw feeder will be explained briefly. As shown in FIG. 4, legs 66 and 68 are fixed to the lower portion of the feeder box in a fork-like manner. A ratchet wheel 70 is rotatably supported between the legs 66 and 68 by means of a shaft 71. As shown in FIG. 1, a plurality of claws 72 are formed circumferentially on both lateral sides of the ratchet wheel 70 and are equally spaced from each other in the circumferential direction. A guide surface 76 is formed on each of the legs 66 and 68 and extends tangentially from the moving locus of the claws 72 so as to provide a guide for a corresponding lateral side of the screw carrying belt B. Although not shown in the drawings, the screw carrying belt B has a series of slots formed on both sides and adapted to be in turn engaged by the claws 72 of the ratchet wheel 70. The ratchet wheel 70 is intermittently rotated in the direction indicated by an arrow in FIG. 1 as the feeder box 58 is reciprocally moved, so that the screw carrying belt B is fed in the leftward direction in FIG. 1.

A ratchet disc **70*a* is pressed on one side of the ratchet wheel 70 by means of a leaf spring 70*b* while it is rotatable relative to the ratchet wheel 70. The ratchet wheel and the ratchet disc 70*a* cooperate to constitute a one-way clutch, so that the ratchet wheel 70 is rotatable only in a direction indicated by the arrow in FIG. 1. A roller pin 78 is mounted on one side of the ratchet disc 70*a*. The roller pin 78 projects into an arcuate elongated slot 80 formed in the leg 68 of the feeder box 58 and further projects into a substantially L-shaped elongated slot 82 formed in the left side plate 56*a* of the case 56. As shown in FIG. 1, a stopper 84 is pivotally supported on the feeder box 58 by means of a pin 86 and is normally biased by a leaf spring 88 in a direction toward the ratchet wheel 70 to engage any one of the claws 72, so that the ratchet wheel 70 is prevented from reverse rotation by the stopper pin 86**.

With this construction, as the feeder box 58 is moved upwardly against the biasing force of the compression coil spring 60, the roller pin 78 moves upwardly along the elongated slot 80, so that the ratchet wheel 70 rotates in the direction indicated by the arrow in FIG. 1 to feed the screw carrying belt B by a distance corresponding to a pitch between two adjacent screws S. When the feeder box 58 is moved downwardly, the roller pin 78 is moved downwardly along the elongated slot 82. Since the ratchet wheel 70 is prevented from reverse rotation by the stopper 84, the ratchet wheel 70 is not moved further and held in a position after it has been rotated by the distance of one pitch of the screws S as described above. The screw carrying belt B is thus moved by a distance of one pitch of the screws S as the feeder box 58 is moved vertically at one stroke.

Figure 10A:
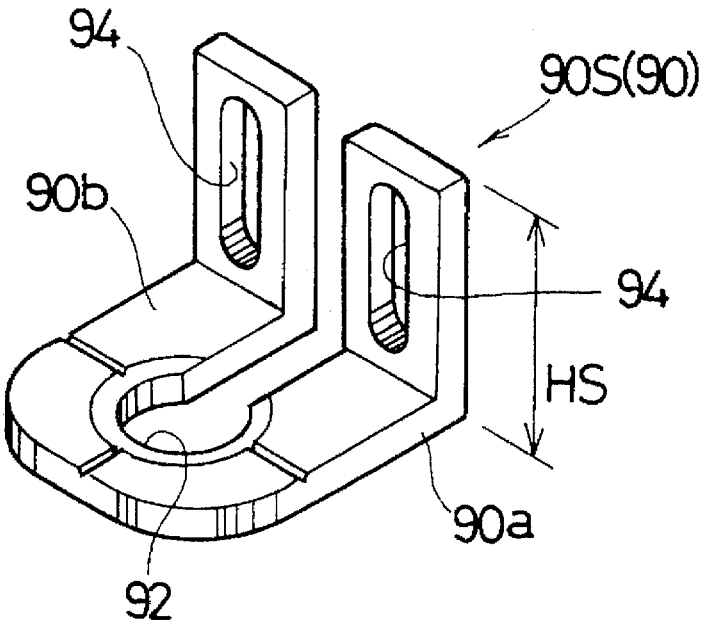
FIG. 10(A) is a perspective view of the short-type stopper base.
Figure 10B:
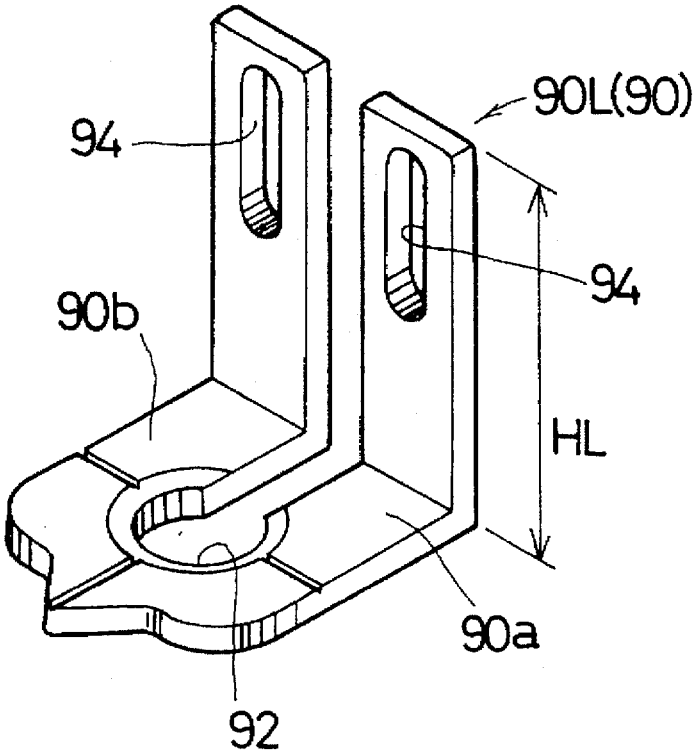
FIG. 10(B) is a perspective view of the long-type stopper base.

An L-shaped stopper base 90 is mounted to the lower ends of the legs 66 and 68. The stopper base 90 has a lower end for abutment on a work W. In this embodiment, a short-type stopper base 90S and a long-type stopper base 90L are prepared to be exchangeably used as the stopper base 90. The short-type stopper base 90S has a short vertical height HS as shown in FIG. 10(A), while the long-type stopper base 90L has a long vertical height HL (>HS) as shown in FIG. 10(B). The short-type stopper base 90S is exclusively applied to the screws S having a relatively short length and particularly to the screws S having the length of 25 mm to 40 mm. The long-type stopper base 90L is exclusively applied to the screws having a greater length which cannot be coped by the short-type stopper base 90S, and particularly to the screws S having the length of 40 mm to 57 mm.

Both the stopper base 90S and 90L have substantially the same configuration except their vertical length (HS, HL), and in the following explanation, the description "stopper base 90" not distinguished by the subscript S or L represents both the stopper bases 90S and 90L. As shown in FIGS. 10(A) and 10(B), each of the stopper bases 90S and 90L has two L-shaped abutting members **90*a* and 90*b* which are joined to each other at their horizontal portions. A slit 92 is formed between the abutting members 90*a* and 90*b* for permitting passage of the screw S. Each of the abutting members 90***a* and 90*b* has a vertically elongated slot 94 for inserting a shank of a screw 96 therein, so that the abutting members 90*a* and 90*b* are fixed to their corresponding legs 66 and 68 by means of the screws 96.

The mounting height of the stopper base 90S or 90L on the feeder box 58 can be varied according to the length of the screws S to be driven. To this end, as shown in FIG. 4, horizontal lower and upper pins 100 and 102 are fixed to each of the legs 66 and 68 and are positioned above the screw 96. In addition, a stepped portion 104 is formed on each of the legs 66 and 68 and is positioned above the upper pin 102. With this construction, each of the stopper base 90S and 90L can be fixed in any of three different positions including a lower position, a middle position and an upper position. In the lower, middle and upper positions, the upper end of each of the abutting members 90*a* and 90*b* abuts on the lower side of the lower pin 100, the lower side of the upper pin 102 and the stepped portion 104, respectively. FIG. 1 shows the state where the long-type stopper base 90L is fixed in the upper position. FIGS. 3 and 4 shows the state where the long-type stopper base 90L is fixed in the lower position. In case of the short-type stopper base 90S, the lower, middle and upper positions are suited for the screws S having the length of 40 mm, 32 mm and 25 mm, respectively. On the other hand, in case of the long-type stopper base 90L, the lower, middle and upper positions are suited for the screws S having the length of 57 mm, 51 mm and 40 mm, respectively. By selecting the type of the stopper base between the short-type stopper base 90S and the long-type stopper base 90L and by selecting the mounting position among the lower, middle and upper positions according to the length of the screws S to be driven, the device can be used to drive six different types of screws S.

Figure 9:
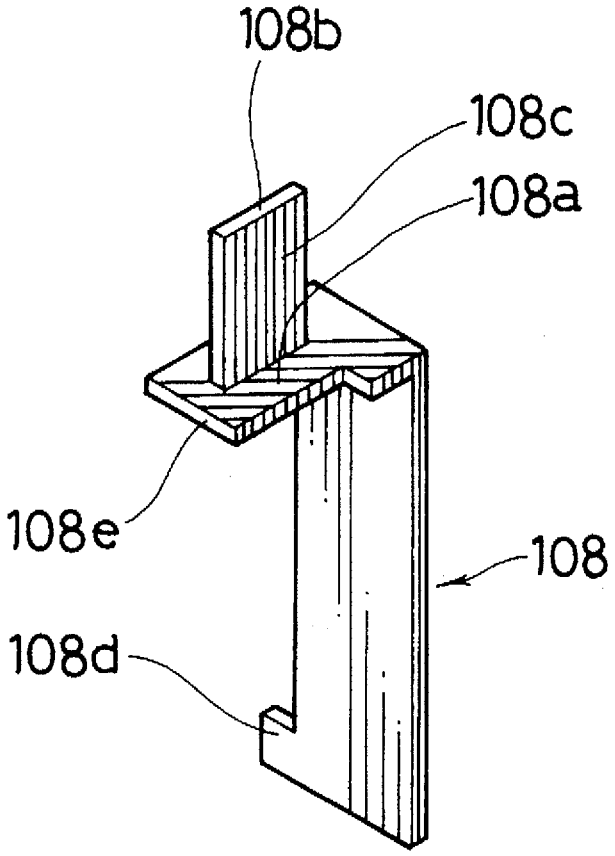
FIG. 9 is a perspective view of an intermediate member.

An intermediate member 108 serves as a movable-side stopper and is disposed upwardly of the stopper base 90. As shown in FIG. 9, the intermediate member 108 has a substantially inverted L-shaped configuration and has an upper portion 108*e* bent horizontally. The upper portion 108*e* has an upper surface defining a lower abutting surface 108*a*. An upstanding plate portion 108*c* having an upper end defining a higher abutting surface 108*b* is formed integrally with the upper portion 108*e* and extending vertically upwardly from the upper surface of the upper portion 108*e*. A lateral projection 108*d* is formed on the lower end of the intermediate member 108.

As shown in FIGS. 3 and 4, the lower portion of the intermediate member 108 is fitted into a recess 58*a* formed on the lateral side of the feeder box 58 and is positioned between the feed box 58 and the right side plate 56*b* confronting the recess 58*a*, so that the intermediate member 108 is vertically slidably movable relative to the feeder box 58. However, as shown in FIG. 3, a second lateral recess 58*b* in communication with the lower part of the recess 58*a* is formed in the feeder box 58, and the lateral projection 108*d* of the intermediate member 108 projects into the second lateral recess 58*b*, so that the uppermost position of the intermediate member 108 is limited to a position shown in FIG. 3. The upper portion 108*e* of the intermediate member 108 extends into a recess 58*c* formed in a rear upper portion of the feeder box 58 in a step-like manner, so that the lowermost position of the intermediate member 108 relative to the feeder box 58 is limited through abutment of the upper portion 108*e* on the bottom of the recess 58*c*.

When the stopper base 90 is in the lower position as shown in FIG. 4, the upper portion 108*e* of the intermediate member 108 is in abutment on the bottom of the recess 58*c* while the lower end of the intermediate member 108 is substantially in abutment on the upper end of the stopper base 90, so that the intermediate member 108 is moved upwardly as the feeder box 58 is moved upwardly together with the stopper base 90. When the stopper base 90 is in the middle or upper position, the abutting height of the lower end of the intermediate member 108 is changed upwardly by a distance between the lower position and the middle or upper position, so that the intermediate member 108 is moved upwardly relative to the feeder box 58, while the intermediate member 108 is moved upwardly as the feeder box 58 is moved upwardly together with the stopper base 90 in the same manner as in the lower position.

Figure 5A:
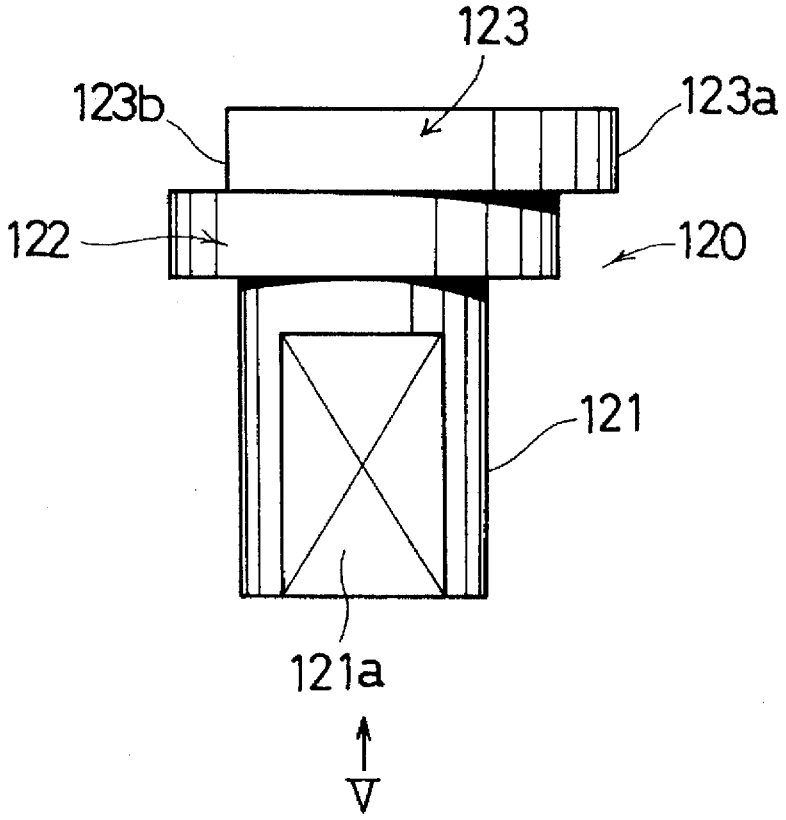
FIG. 5(A) is a plan view of a shifter pin.
Figure 5B:
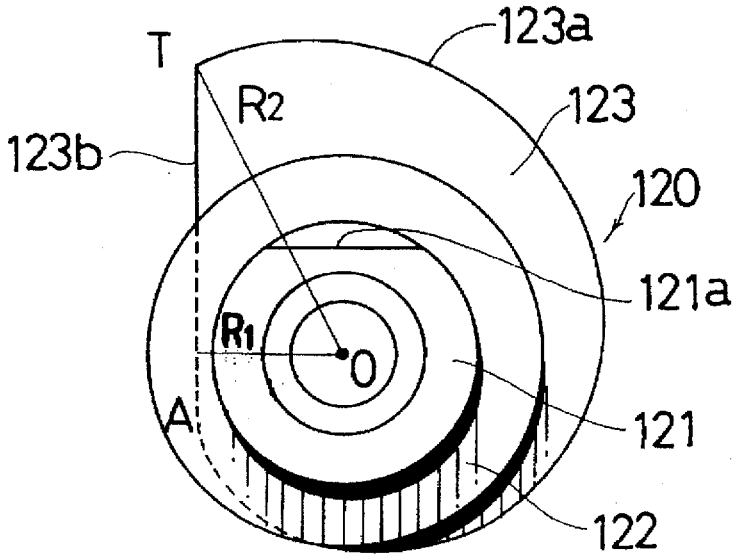
FIG. 5(B) is a view of the shifter pin as viewed in a direction indicated by an arrow V in FIG. 5(A)

A shifter pin 120 having a cam plate 123 which serves as a fixed-side stopper is mounted on the upper portion of the case 56. As shown in FIG. 2, the shifter pin 120 has a shaft 121 which extends horizontally through an insertion hole 56*d* formed in the rear side plate 56*c* of the case 56 and which is rotatable and axially movable relative to the rear side plate 56*c*. An adjusting knob 116 has a central mounting hole 116*a* through which the adjusting knob 116 is axially slidably fitted on the shifter pin 120 on the outside of the rear side plate 56*e*. A washer 117 is fixed to the outer end of the shaft 121 by means of a flat countersunk head screw 118. A circular recess 116*b* is formed in the adjusting knob 116 coaxially with the mounting hole 116*a*. The circular recess 116*a* has a cylindrical bottom part in which a compression coil spring 119 is inserted to be interposed between the bottom of the cylindrical recess 116*b* and the washer 117. The compression coil spring 119 serves to press the adjusting knob 116 on the outer surface of the rear side plate 56*c* and to normally bias the shaft 121 of the shifter pin 120 in a direction to extend outwardly from the mounting hole 116*a* of the adjusting knob 116 (rightward direction in FIG. 2). As shown in FIG. 5, a flat surface 121*a* is formed on an outer surface of the shaft 121 of the shifter pin 120, and the mounting hole 116*a* of the adjusting knob 116 is configured to have a corresponding flat wall part, so that the shifter pin 120 is rotatable with the adjusting knob 116.

A plurality of protrusions 56*e* are formed on the outer surface of the rear side plate 56*c* of case 56 and confront the peripheral portion of the back surface of the adjusting knob 116 in which a plurality of substantially cone-shaped recess 116*c* are formed in spaced relationship with each other in the circumferential direction for engagement with the protrusions 56*e*, so that the adjusting knob 116*b* can be held in a desired adjusting position and that an excellent operation feeling can be obtained when the operator rotates the adjusting knob 116. A plurality of radial fins 116*d* are formed on the outer peripheral surface of the adjusting knob 116 and serve to prevent fingers of the operator from slippage when he rotates the adjusting knob 116.

One end of the shifter pin 120 positioned inside of the case 56 has a stopper flange 122 and the cam plate 123 formed integrally with the shifter pin 120 and in series in the axial direction. The cam plate 123 is positioned at the frontmost position of the shifter pin 120. As shown in FIG. 5, the stopper flange 122 has a circular configuration coaxial with the shaft 121 and having a diameter greater than the diameter of the shaft 121. The cam plate 123 has a curved cam surface 123*a* and a linear cam surface 123*b*. The curved cam surface 123*a* has a diameter (taken a center 0 of the shaft 121 as a center) varying continuously from a minimum distance R1 at a start point A to a maximum distance R2 at an end point T.

The shifter pin 120 is movable axially between a first position and a second position where the cam plate 123 confronts the lower abutting surface 108*a* and the higher abutting surface 108*b* of the intermediate member 108, respectively. Thus, in the first position shown in FIGS. 1 and 2, the stopper flange 122 is held in abutment on the back surface of the rear side plate 56*c* by means of the compression coil spring 119, so that the cam plate 123 is positioned on the side of the rear side plate 56*c*. When the operator pushes the washer 117 into the circular recess 116*a* of the adjusting knob 116, the shifter pin 120 is shifted to the second position leftwardly of the first position in FIGS. 1 and 2 and is held in position by a switching plate 130 which is operable to prevent the shifter pin 120 from returning to the first position as will be explained later.

As shown in FIGS. 3, 4, 6(A) and 6(B), the switching plate 130 extends between the right and left side plates 56*a* and 56*b* and is positioned above the shifter pin 120. The switching plate 130 has both sides extending outwardly of the right and left side plates 56*a* and 56*b* through corresponding slots formed therein, so that the switching plate 130 is slidably movable in the lateral direction.

The switching plate 130 has a central portion in its longitudinal direction which includes a small diameter recess 130*a* and a large diameter recess 130*b* both having a substantially semi-circular configuration and formed adjacent to each other on the lower side of the switching plate 130 confronting the shifter pin 120. The small diameter recess 130*a* has a diameter substantially equal to the diameter of the shaft 121 of the shifter pin 120, and the large diameter recess 130*b* has a diameter substantially equal to the diameter of the stopper flange 122. Since the diameter of the stopper flange 122 is greater than the diameter of the shaft 121, the stopper flange 122 cannot pass through the small diameter recess 130*a*. Two V-shaped recesses 130*c* and 130*d* are formed on the upper side of the switching plate 130 and are positioned in alignment with the centers of the small diameter recess 130*a* and the large diameter recess 130*b* in the vertical direction, respectively. The fork-like member 57 for fixing the case 56 to the bearing 30 has a rear end having a recess which cooperates with the rear side plate 56*c* to form a space for accommodating a leaf spring 131. The leaf spring 131 has a downwardly projecting portion 131*a* which is engageable with any of the V-shaped recesses 130*c* and 130*d* of the shifting plate 130, so that the shifting plate 130 can be selectively held in positioned between a first engaging position and a second engaging position where the projecting portion 131*a* of the leaf spring 131 is in engagement with the V-shaped recesses 130*d* and 130*c*, respectively.

Figure 6A:
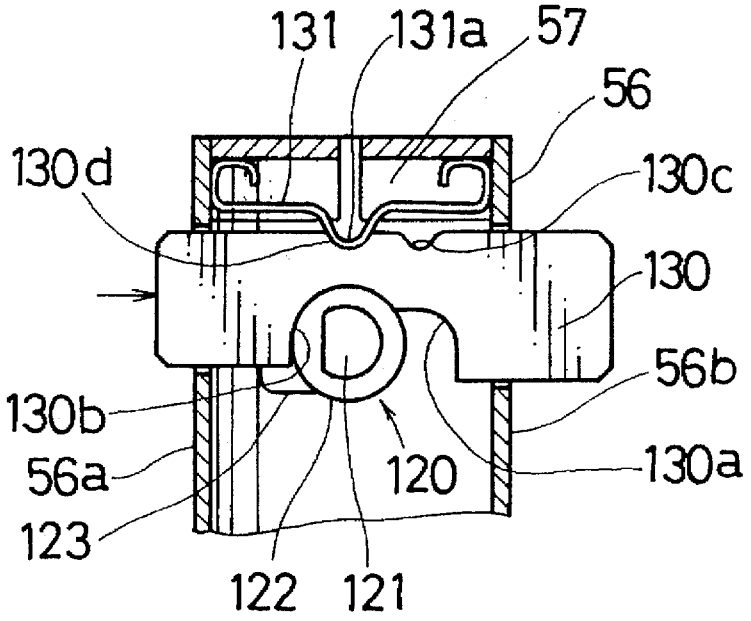
FIGS. 6(A) and 6(B) are front views showing a switching plate in right and left positions, respectively.
Figure 6B:
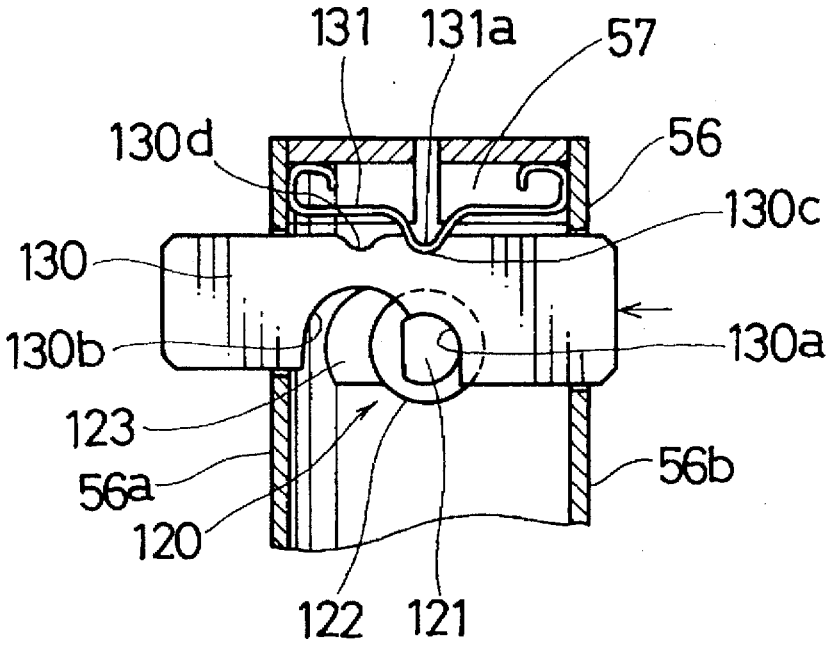

When the switching plate 130 is in the first engaging position shown in FIG. 6(A), the large diameter recess 130*b* is in engagement with the shifter pin 120. Since the stopper flange 122 can pass through the diameter recess 130*b*, the shifter pin 120 can be moved to return to the first position from the second position by the biasing force of the compression coil spring 119. On the other hand, when the switching plate 130 is moved from the first engaging position to the second engaging position shown in FIG. 6(B) where the small diameter recess 130*a* is in engagement with the shaft 121 after the shifter pin 120 has been moved from the first position to the second position by pushing the washer 117 into the circular recess 116*b* against the biasing force of the compression coil spring 119, the shifter pin 120 is held in the second position since the stopper flange 122 cannot pass through the small diameter recess 130*a*. Thus, when the shifter pin 120 is in the second position, the switching plate 130 is interposed between the stopper flange 122 and the rear side plate 56*c* of the case 56 to prevent the shifter pin 120 from moving to the first position.

When the shifter pin 120 is in the first position, the cam plate 123 confronts the lower abutting surface 108*a* of the intermediate member 108 in the vertical direction. On the other hand, when the shifter pin 120 is in the second position, the cam plate 123 confronts the higher abutting surface 108*b*. Therefore, when the intermediate member 108 is moved upwardly together with the stopper base 109 with the shifter pin 120 positioned in the second position, the higher abutting surface 108*b* abuts on either one of the curved cam surface 123*a* or the linear cam surface 123*b* of the cam plate 123. On the other hand, when the intermediate member 108 is returned to the first position by switching the switching plate 130 to the first engaging position, the lower abutting surface 108*a* of the intermediate member 108 abuts on either one of the curved cam surface 123*a* or the linear cam surface 123*b*. Thus, the lower abutting surface 108*a* becomes effective when the shifter pin 120 is in the first position, while the higher abutting surface 108*b* becomes effective when the shifter pin 120 is in the second position. Since the lower abutting surface 108*a* and the higher abutting surface 108*b* are displaced in the vertical direction corresponding to the length of the upstanding plate portion 108*c*, the stroke of the intermediate member 108 or the stopper base 90 varies by the distance of the length of the upstanding plate portion 108*c*.

The shifter pin 120 is switched between the first position and the second positions according to the type of the stopper base 90 to be mounted on the intermediate member 108. When the short-type stopper base 90S is mounted on the intermediate member 108, the shifter pin 120 is shifted to the second position, so that the higher abutting surface 108*b* becomes effective to provide a shorter stroke of the stopper base 90S. When the long-type stopper base 90L is mounted, the shifter pin 120 is shifted to return to the first position, so that the lower abutting surface 108*a* becomes effective to provide a longer stroke of the stopper base 90L. Here, the difference between the height of the lower and higher abutting surfaces 108*a* and 108*b* or the length of the upstanding plate portion 108*c* is determined to be equal to the difference (HL-HS) between the vertical height of the stopper bases 90S and 90L.

The operation of the continuous screw driving tool 1 as described above will now be explained.

Figure 7A:
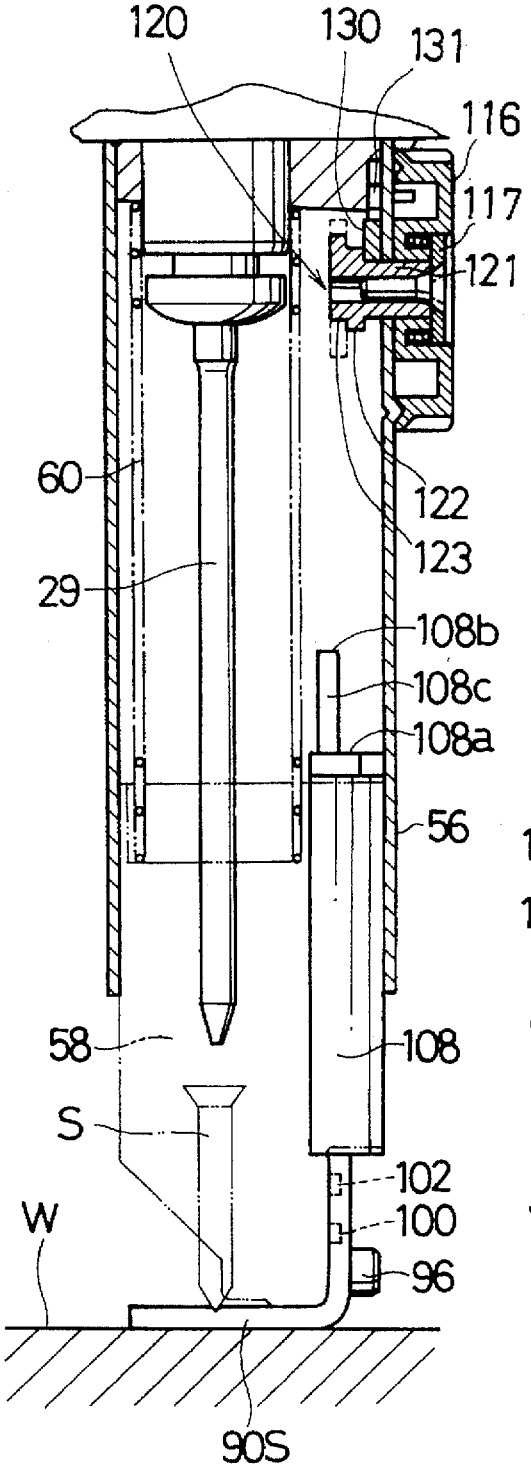
FIG. 7(A) is a vertical sectional view showing the essential parts of the tool, with a short-type stopper base mounted thereon when a body of the tool is not pressed on a work.

When the screws S having the length of 25 mm are to be driven, the operator mounts the short-type stopper base 90S on the feeder box 68 at the upper position as shown in FIG. 7(A). In accordance with the selection of the short-type stopper base 90S, the operator pushes the shifter pin 120 and switches the switching plate 130 to the second engaging position shown in FIG. 6(B), so that the shifter pin 120 is held in the second position.

After this setting operation, the operator grasps the body 10 with his hands and turns on the trigger switch 17 to drive the motor. At this stage, the clutch mechanism is disconnected, and therefore, the spindle 10 is not rotated. The operator then moves the body 10 to bring the stopper base 90S to abut on the work W, so that the body 10 and the case 56 is moved downwardly or that the feeder box 58 moves upwardly into the case 56 against the biasing force of the spring 60. As the feeder box 58 is thus moved, the ratchet wheel 70 is rotated in the direction indicated by the arrow in FIG. 1, so that the screw carrying belt B is moved by a distance corresponding to the pitch between two adjacent screws S. With this movement, one of the screws S is positioned to vertically confront the driver bit 29.

When the body 10 is further moved downwardly or when the feeder box 58 is further moved into the case 56, the driver bit 29 abuts on and engages the screw S positioned below, so that this screw S is removed from the screw carrying belt B and is moved downwardly to abut on the work S. When the driver bit 29 is further pressed downwardly toward the work S, the clutch mechanism is connected due to the downward pressing force applied to the driver bit 29. Then, the rotation of the motor is transmitted to the spindle 28 to rotate the screw S for driving the same into the work W.

On the other hand, when the short-type stopper base 90S in the upper position, the intermediate member 108 is in abutment on the upper end of the stopper base 90S by its gravity, while its upper portion **108*e* is positioned upwardly of the bottom of the recess 58*c* by the distance corresponding the distance between the lower position and the upper position of the stopper base 90S. Therefore, as the stopper base 90S is moved upwardly as described above, the intermediate member 108** also moves upwardly.

Figure 7B:
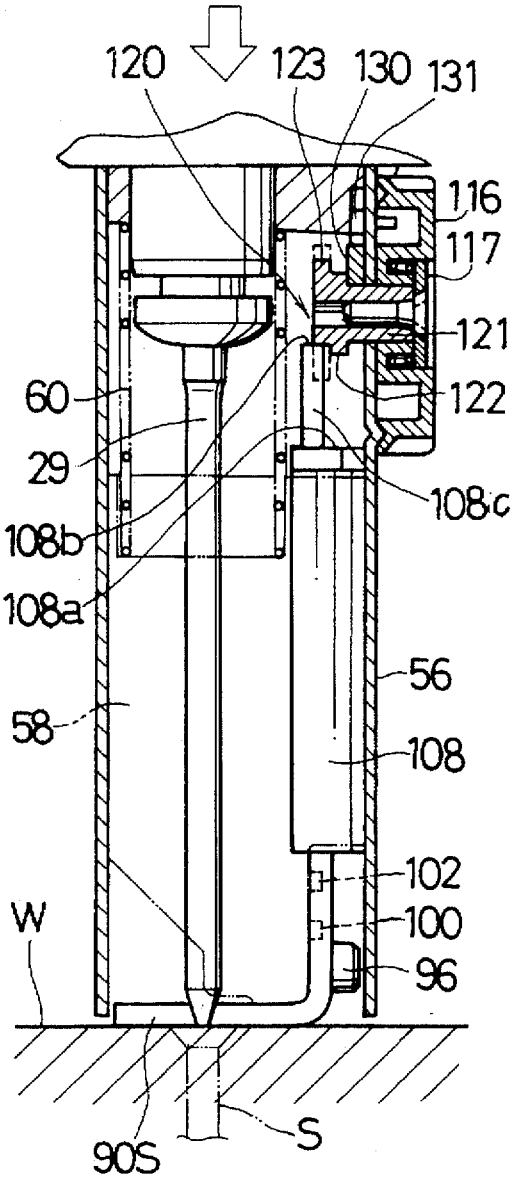
FIG. 7(B) is a view similar to FIG. 7(A) but showing the screw which has been completely driven into the work.

The upward movement of the stopper base 90S is stopped when the higher abutting surface **108*b* of the intermediate member 108 abuts on the cam plate 123 of the shifter pin 120 as shown in FIG. 7(B), so that the screw S is driven into the work W by a predetermined depth. When the screw S has been completely driven, the clutch mechanism is disconnected, and the rotation of the spindle 28** is stopped.

When the operator releases the downward pressing force applied to the body 10, the body 10 and the case 56 move upwardly by the biasing force of the spring 60 while the feeder box 58 and the stopper base 90S remain in the lowered position. On cycle of the driving operation of the screw S is thus completed.

If the screws S to be driven are the length of 32 mm and the 40 mm, the stopper base 90S is positioned to the middle position and the lower position, respectively, so that the same driving operation as in case of the screws S having the length of 25 mm can be performed with the distance between the lower end of the stopper base 90S and the lower end of the screw S held in a constant value. Thus, the operation from the step of removing the screw S from the screw carrying belt B to the step of abutment of the screw S on the work W can be performed in the same manner irrespective of the length of the screws S.

The upper stroke end of the stopper base 90S is limited by the abutment of the higher abutting surface **108*b* of the intermediate member 108 on the cam plate 123 of the shifter pin 120, and this upper stroke becomes shorter as the mounting position of the stopper base 90S relative to the feeder box 58 becomes higher. Thus, the distance of the stroke movement of the stopper base 90S is automatically suitably adjusted by changing the position of the stopper base 90S** according to the length of the screws S.

In addition, by rotating the adjusting knob 116 to vary the rotational position of the cam plate 123, the abutting height of the higher abutting surface **108*b* on the cam surface 123*a*** can be changed in a continuous manner, so that a fine adjustment of the driving depth of the screw S can be performed.

Figure 8A:
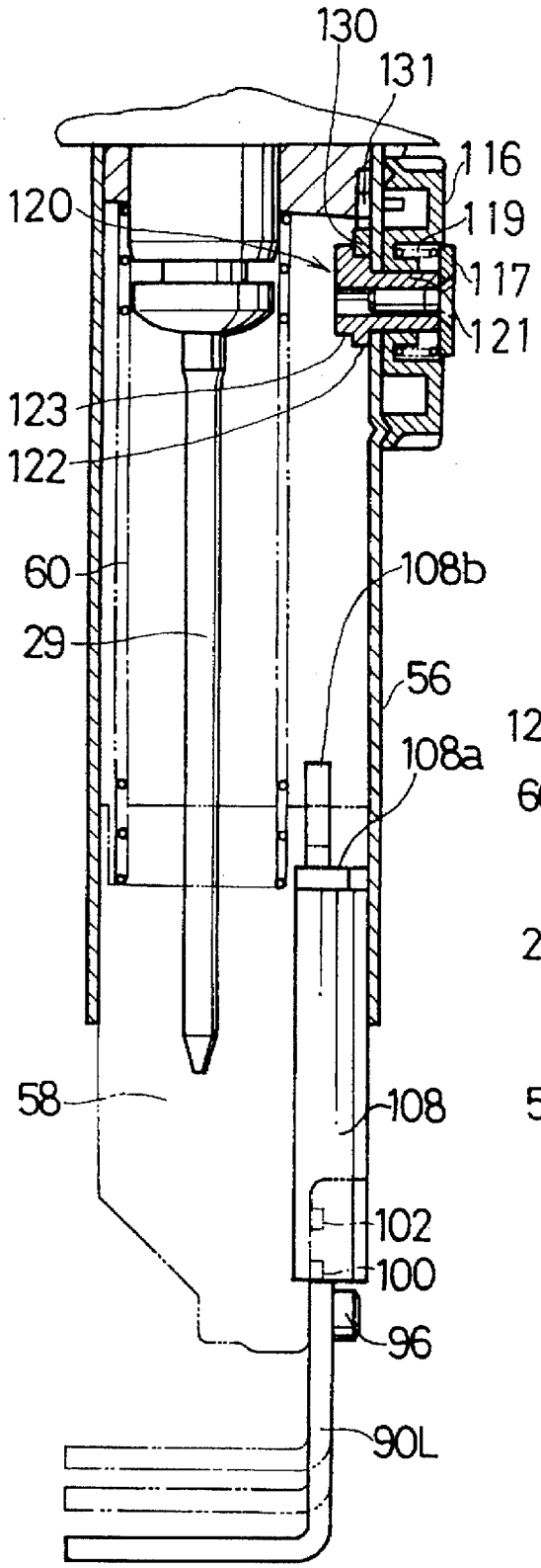
FIG. 8(A) is a view similar to FIG. 7(A) but showing a long-type stopper base mounted on the tool.
Figure 8B:
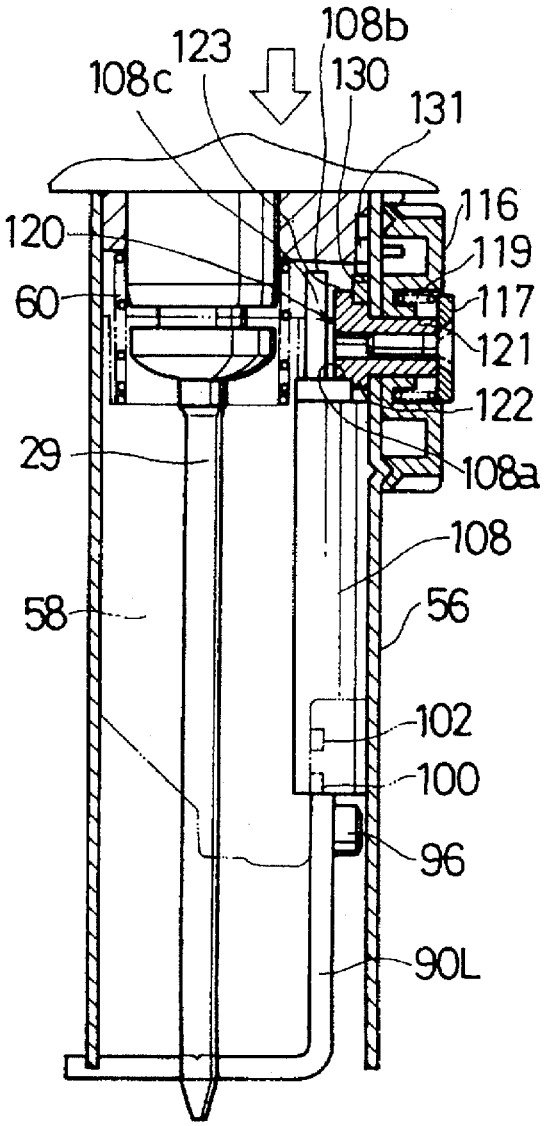
FIG. 8(B) is a view similar to FIG. 7(B) but showing the screw which has been completely driven into the work.

When the screws S having the length of 57 mm are to be driven, the short-type stopper base 90S is no longer applicable to this purpose. In this case, the screws 96 are loosened to change the short-type stopper base 90S to the long-type stopper base 90L. For the length of 57 mm, the long-type stopper base 90L is mounted on the feeder box 58 at the lower position, and the switching plate 130 is switched to the first engaging position shown in FIG. 6(A) so as to shift the shifter pin 120 to the first position and so as to bring the lower abutting surface **108*a* effective. This setting situation is shown in FIG. 8(A). Chain lines in FIG. 8(A) show the lower horizontal portion of the stopper base 90L** in the middle and upper positions for the screws S having the length of 51 mm and 40 mm, respectively.

With the long-type stopper base 90L positioned in the lower position, the operator presses the body 10 to bring the stopper base 90L to abut on the work, so that the driver bit 29 abuts on and engages the screw S confronting the driver bit 29 to remove the same from the screw carrying belt B and to drive the same into the work W through rotation of the driver bit 29 as described in connection with the short-type stopper base 90S. On the other hand, as the stopper base 90L is moved upwardly, the intermediate member 108 is moved upwardly until the lower abutting surface **108*a* abuts on the cam plate 123 of the shifter pin 120**. The driving operation of the screw S having the length of 57 mm is thus completed.

As described above, with the continuous screw driving tool 1 of this embodiment, two types of stopper bases 90S and 90L having different length in the vertical direction are used to be mounted on the feeder box 58. Further, these stopper bases 90S and 90L are mounted on the feeder box 58 at three different heights, respectively. According to the type of the stopper base 90 to be used, the shifter pin 120 is shifted between the first position and the second position where the cam plate 123 confronts the lower abutting surface **108*a* and the higher abutting surface 108*b*, respectively. Thus, the upper stroke end of the stopper base 90 is changed as the type of the stopper base 90 is changed, so that the tool 1** can cope with a broader range of length of the screws S to be driven.

A second embodiment of the present invention will now explained with reference to FIGS. 11(A), 11(B), 12 and 13. The construction of this embodiment is the same as the first embodiment except the shifter pin 120 and the intermediate member 108. Like numerals are given the same referece numerals and their description will not be repeated.

Figure 11A:
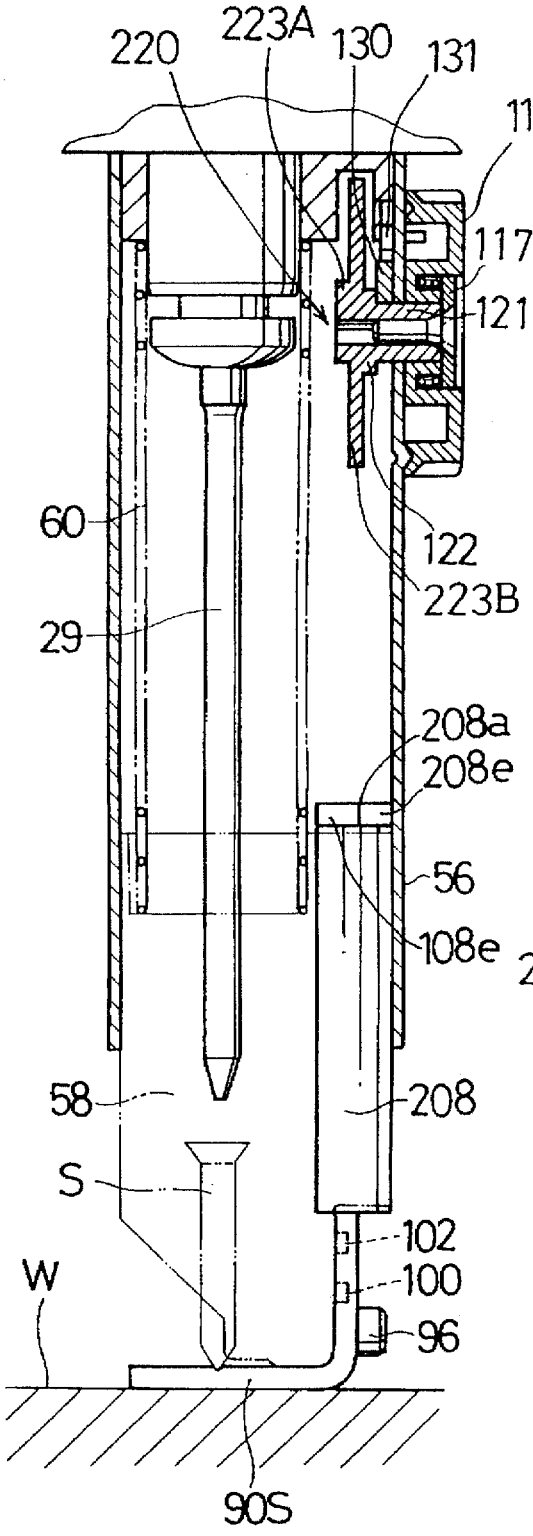
FIG. 11(A) is a vertical sectional view of the essential parts of a continuous screw driving tool according to a second embodiment of the present invention with a short-type stopper base mounted thereon when a body of the tool is not pressed on a work.
Figure 11B:
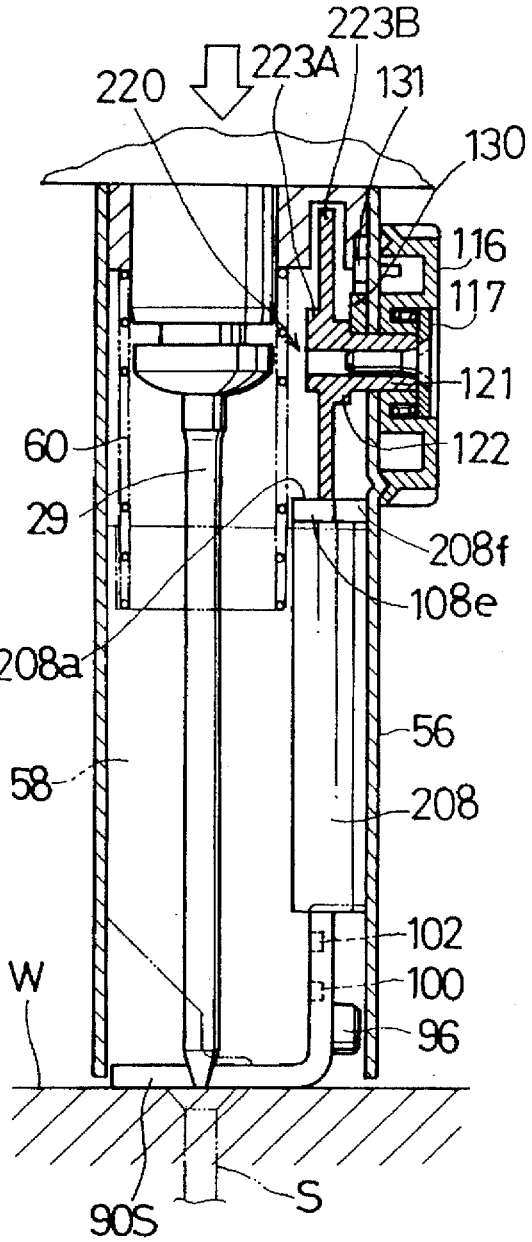
FIG. 11(B) is a view similar to FIG. 7(B) but showing the screw which has been completely driven into the work.
Figure 12:
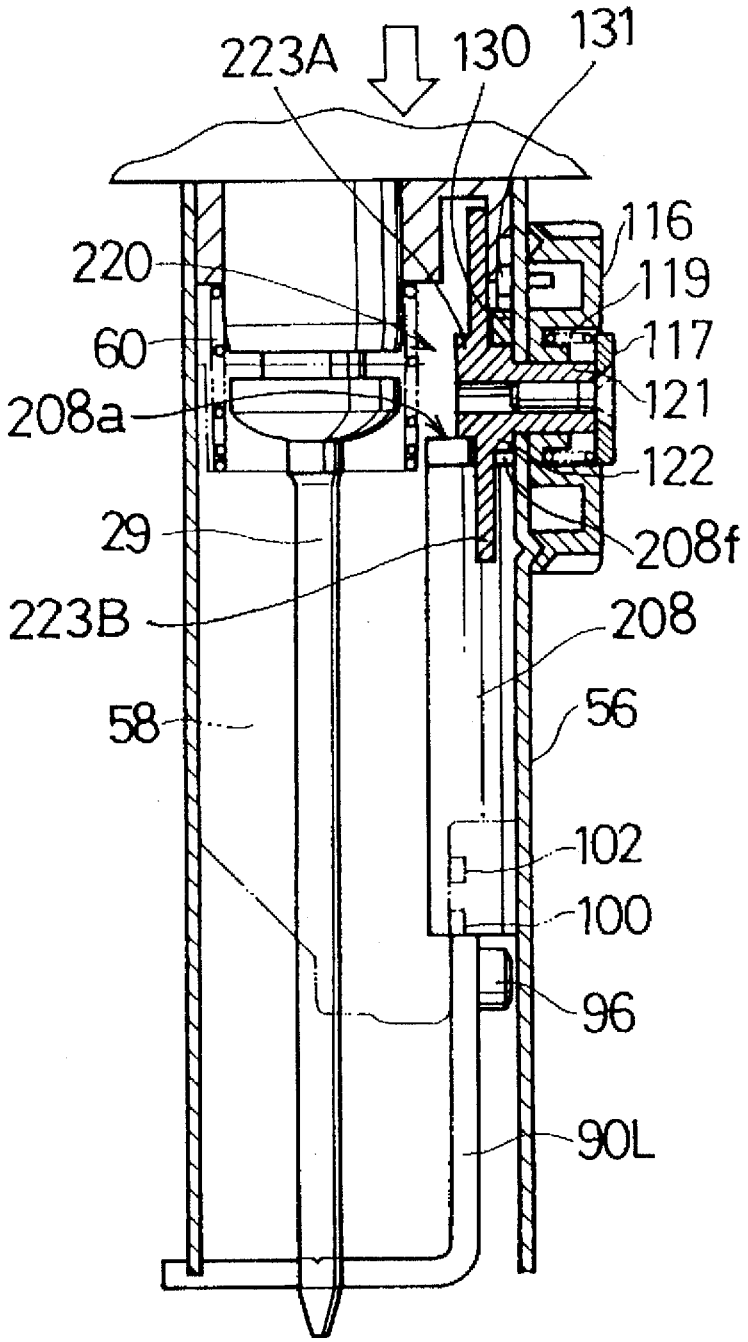
FIG. 12 is a view similar to FIG. 11(B) but showing the long-type stopper base mounted thereon.

As with the shifter pin 120 of the first embodiment, a shifter pin 220 of the second embodiment is shiftable between a first position shown in FIG. 12 and a second position shown in FIGS. 11(A) and 11(B) corresponding to the first position and the second position of the shifter pin 120 of the first embodiment, and the shifter pin 220 can be fixed in position in either one of these positions. The shifter pin 220 has a first cam plate 223A and a second cam plate 223B positined at the front end of the shifter pin 220 in place of the cam plate 123 of the first embodiment. The first and second cam plates 223A and 223B are positioned adjacent to each other in the axial direction of the shifter pin 220. The first cam plate 223A positioned on the front side has a configurartion substantially identical with the configuration of the cam plate 123 of the first embodiment. The second cam plate 223B positioned on the rear side has a configuration analogus to the configuration of the cam plate 123 but has a size greater than the cam plate 123. More specifically, the size of the second cam plate 223B is greater than the size of the cam plate 123 or the first cam plate 223A by a radius corresponding to the distance between the lower abutting surface **108*a* and the higher abuting surface 108*b* of the intermediate member 108** of the first embodiment.

Figure 13:
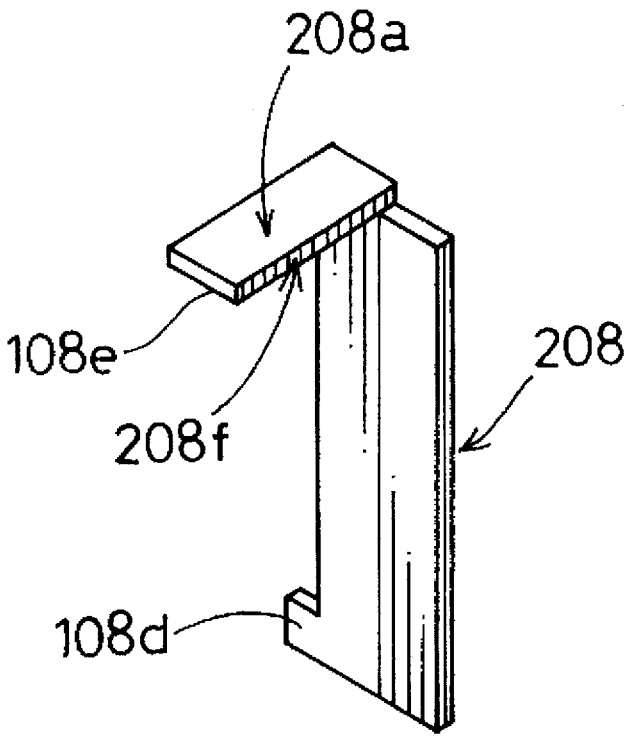
FIG. 13 is a perspective view of an intermediate member of the second embodiment.

In addition, as shown in FIG. 13, an intermediate member 208 of this embodiment has a single abutting surface **208*a* which is defined on an upper surface of the horizontal upper portion 108*e*. A cut-out recess 208*f* is formed on the rear side of the upper portion 108*e* and has a length in the forward and rearward directions substantially equal to the length of the upper portion 108***e* in the same direction. The cut-out recess 208*f* provides a gap between the upper portion 108*e* and a part of the rear side plate 56*c* of the case 56 confronting the upper portion 108*e*, so that the lower portion of the second cam plate 223B is permitted to extend downwardly through this gap when the shifter pin 220 is positioned in the first position shown in FIG. 12.

The operation of this embodiment is substantially the same as that of the first embodiment. When the short-type stopper base 90S is to be used, the operator shifts the shifter pin 220 to the second position as shown in FIG. 11(A). The upper stroke movement of the stoper base 90S is therefore stopped through abutment of the abutting surface 208*a* of the intermediate member 208 on the second cam plate 223B having the larger size as shown in FIG. 11(B), so that the same upper stroke end of the stoper base 90S can be obtained as in the case of the first embodiment.

When the long-type stopper base 90L is to be used, the operator shifts the shifter pin 220 to the first position, so that the upper stroke movement of the stoper base 90L is stopped through abutment of the abutting surface 208*a* on the first cam plate 223A having the smaller size, while the lower portion of the second cam plate 223B extends downwardly through the cut-out recess 208*f*, so that the same upper stroke end of the stopper base 90L can be obtained as in the case of the first embodiment.

In either case of the sheet-type stopper base 90S and the long-type stopper base 90L, the fine adjustment of the upper stroke end of the stopper base can be performed by rotating the shifter pin 220 through the adjusting knob 116.

While the invention has been described with reference to preferred embodiments thereof, it is to be understood that modifications or variations may be easily made without departing from the spirit of this invention which is defined by the appended claims.

What is claimed is:

1. A continuous-screw driving tool comprising:

a body having spindle rotatably driven by a drive device and adapted for mounting a driver bit thereon;

a case mounted on said body and having a longitudinal axis parallel to a longitudinal axis of said spindle;

a feeder box movable relative to said case in the axial direction of said case;

a stopper base mounted on said feeder box and movable therewith for abutment on a work into which a screw is to be driven;

first stopper means for limiting a first stroke end of said stopper base in a direction to extend outwardly from the case;

second stopper means for limiting a second stroke end of said stopper base on the side opposite to said first stroke end;

biasing means for normally biasing said stopper base in a direction toward said first stroke end;

screw feeding means operable to feed screws carried on a screw carrying belt to a position confronting said driver bit one after another when said stopper base is moved from said first stroke end toward said second stroke end against the biasing force of said biasing means;

said second stopper means including a first stopper member on the side of said case and a second stopper member on the side of said stopper base for abutment on said first stopper member, said second stopper member being movable with said stopper base as said stopper base is moved toward said second stroke end;

said feeder box being adapted to selectively mount any one of plural kinds of interchangeable stopper bases each suited for a different group of screws having different lengths; and stroke changing means for changing the position of said second stroke end in accordance with an exchange of said stopper bases, said stroke changing means including a plurality of first abutting surfaces formed on one of said first and second stopper members, a single second abutting surface formed on the other, said first abutting surfaces being offset from each other in a direction parallel to said longitudinal axis of said case, and laterally offset from each other perpendicular to said longitudinal axis of said case, and shifting means for laterally shifting said first and second stopper members relative to each other, so that said second abutting surface selectively confronts either of said first abutting surfaces.

2. The continuous screw driving tool as defined in claim 1 further including position determining means for determining fixed positions for said stopper base on said feeder box in accord with screws adapted to the selected stopper base.

3. The continuous screw driving tool as defined in claim 1 wherein said shifting means is operable to move said first stopper member relative to said case.

4. The continuous screw driving tool as defined in claim 1 further including means for selectively holding said shifting means in any shifting position where said second abutting surface confronts any one of said first abutting surfaces.

5. The continuous screw driving tool as defined in claim 3 wherein said shifting means includes an operation knob mounted on said case and operable by an operator, and wherein said first stopper member is provided on said operation knob.

6. The continuous screw driving tool as defined in claim 5 wherein said operation knob is operable by the operator to perform a fine adjustment of the abutting position between said second abutting surface and any one of said first abutting surfaces.

* * * * *